US006427836B1

(12) United States Patent
Bolanos

(10) Patent No.: US 6,427,836 B1
(45) Date of Patent: Aug. 6, 2002

(54) WALLET IDENTIFICATION CARD HOLDER

(75) Inventor: Thomas Bolanos, Clayton, MO (US)

(73) Assignee: TRG Accessories, L.L.C., St. Louis, MO (US)

( * ) Notice: Subject to any disclaimer, the term of this patent is extended or adjusted under 35 U.S.C. 154(b) by 0 days.

(21) Appl. No.: 09/484,514

(22) Filed: Jan. 18, 2000

(51) Int. Cl.[7] ..... A45C 11/18

(52) U.S. Cl. ..... 206/449; D3/247; 40/654.01; 40/775; 150/148; 206/39

(58) Field of Search ..... 40/649, 654.01, 40/643, 644, 653, 654, 775, 776; 150/147–149, 138; D3/247

(56) References Cited

U.S. PATENT DOCUMENTS

| | | | | | |
|---|---|---|---|---|---|
| 270,108 | A | * | 1/1883 | Pennington | 40/653 |
| 2,289,118 | A | * | 7/1942 | Hatton | 40/775 |
| 2,643,474 | A | * | 6/1953 | Grenot | 206/39 |
| 3,293,779 | A | * | 12/1966 | Vogeli, Sr. | 40/643 |
| 4,141,400 | A | * | 2/1979 | Mangan | 206/39.6 |
| D256,852 | S | * | 9/1980 | McGahee | D3/247 |
| 4,450,955 | A | * | 5/1984 | Featherston | 40/649 |
| 4,674,628 | A | * | 6/1987 | Prinsloo et al. | 206/39 |
| 4,942,913 | A | * | 7/1990 | Musso | 150/138 |
| 5,020,255 | A | * | 6/1991 | Rodel | 206/39.5 |
| 5,080,223 | A | * | 1/1992 | Mitsuyama | 206/39.5 |
| D337,656 | S | * | 7/1993 | Hostert | D3/247 |
| 5,595,401 | A | * | 1/1997 | Exline et al. | 281/31 |
| 5,938,010 | A | * | 8/1999 | Osterbye | 206/38 |
| 6,082,422 | A | * | 7/2000 | Kaminski | 150/147 |
| 6,105,294 | A | * | 8/2000 | Goodfellow | 40/654.01 |
| 6,105,298 | A | * | 8/2000 | Grayson et al. | 40/776 |

* cited by examiner

*Primary Examiner*—Jim Foster
(74) *Attorney, Agent, or Firm*—Lewis, Rice & Fingersh, L.C.

(57) ABSTRACT

An identification card sleeve for use in a wallet or the like includes a semi-rigid tray with an edge channel surrounding three sides of the periphery of the tray to define a slot within which an identification card may be inserted or removed. A finger grab or tap is located on the side of the tray without the edge channel and provides a convenient locator and handle for inserting or removing the sleeve from a wallet slot. The front of the identification card is not obscured by any covering over the card and the relatively thin construction of the sleeve does not add significantly to the bulk or thickness of a wallet within which it is carried.

24 Claims, 2 Drawing Sheets

WALLET IDENTIFICATION CARD HOLDER

BACKGROUND AND SUMMARY OF THE INVENTION

Most individuals carry some kind of wallet or the like as a convenient means for organizing and holding all manner of credit cards, driving licenses, membership cards, and the like. Typically, these wallets have slots for conveniently receiving and holding the credit cards, driving licenses, etc. for ready access. These slots may be offset from one another such that a portion of each card is viewable as a cue for the owner to properly select the correct card as its use is required. For the majority of the male population, these wallets are typically carried in a hip pocket so that the thickness of the wallet is a dimension of some importance in considering the convenience, ease, and comfort of carrying the wallet. In present day times, it is not uncommon for an individual to have five or more credit cards, a driving license, airline travel card, book club card, and other various cards totally 10, 12, or even more desired to be carried and readily accessible for use. Thus, the ability to carry, organize, and gain ready access to particular cards is a matter of some importance for most people.

Of all of the cards typically carried today, perhaps a user's motor vehicle license or "drivers license" is the single card most often accessed and required to be removed from the wallet. Such access is required in many instances including particularly when a user's identity is desired to be established for check cashing, credit card use, hotel and airline check-in, and even under those unfortunate circumstances when a user is questioned by authorities such as police officers. For this reason, many wallets provide a special compartment for placing and carrying a drivers motor vehicle license. This specialized compartment is generally located in a separate location from the other credit cards and has a glassine or transparent cover over it through which the face of the drivers license may be viewed as it remains in the wallet. However, this glassine material is subject to "scuffing" or other wearing and even abuse which renders it problematic for clear viewing of the drivers license stored beneath it. Furthermore, the inquiring individual may ask that it be removed from the wallet, or the user may desire not to hand over his entire wallet containing other credit cards and perhaps even cash under those circumstances. Therefore, it is not uncommon for many people to experience multiple occasions for use of their drivers license requiring its removal from the wallet and replacement back into the wallet in its appropriate slot.

Continued access, removal and reinsertion of a drivers license in and out of a wallet can be inconvenient at least, and perhaps even result in undesired wear and tear. Generally, most states drivers licenses are ruggedized to some extent, but are still rather flexible, "card like" material and not comprised of sturdy molded plastic as is the typical credit card. Furthermore, for security purposes, the specialized slots in most wallets is sized to securely hold the license there within so that the license card slot may be deeper than the card, thereby allowing the card to sink into the slot, and below the upper edge of the slot, making it in some cases much more difficult than could be expected for grasping the upper edge of the card and removing it from the slot. In those circumstances where an individual is confronted with an emotional situation, this can result in undesired fumbling in an effort to remove the card, making the user nervous and undoubtedly conveying an impression unintended and undesired to be conveyed by the user at that time.

The inventor herein is aware of luggage identification card holders and the like which provide a blank of no particularly standardized size for a user to write in his name and address with a carrying case and attachment for securing the luggage tag to the luggage. In many instances, these luggage tags are sized to accept a standard business card and may even have a glassine panel overlying the business card to protect it as luggage experiences extreme abuse during handling, especially by the airlines. While these luggage identification card holders do serve a valuable purpose, they are generally bulky and ruggedized to stand up under the extreme conditions they encounter as they are exposed to the elements and direct handling by baggage clerks and the like.

In order to solve these problems in the prior art, and to provide a means for protecting, storing, and readily accessing a drivers license or other desired card within a wallet, the inventor herein has succeeded in designing and developing a specially adapted sleeve for receiving and holding a drivers license or the like with the sleeve being relatively thin and sized to be not much larger than the drivers license itself. This sleeve includes an edge channel surrounding three sides of the generally rectangularly shaped sleeve with the edged channel itself being relatively thin and spaced close to the underlying flat panel surface such that it remains relatively thin as would be desired for a user's wallet. The drivers license may thus be readily inserted by placing its edges to line up with the slots defined between the edge channels and the underlying flat panel and slid thereinto to overlie the flat panel. As the drivers license sits within the sleeve, the upper surface of the license is exposed and remains uncovered for ready access and clear viewing thereof within the sleeve. Along the edge of the sleeve which does not have a peripheral edge channel, a tab or "finger grab" is formed integrally with the flat panel surface and may have a number of textured ribs as an aid for a user to simply grab the sleeve and withdraw it from within the wallet slot. Thus, during use, a user may simply place his license permanently within the sleeve, place the sleeve within the wallet slot, and be able to identify the drivers license by the tab as well as remove it conveniently from the wallet slot with the same tab when access to the drivers license is desired. As there is no glassine or other protecting covering over the drivers license, it may be readily viewed directly by those individuals desiring to inspect it such that it is anticipated that most will not require the drivers license to be removed from the sleeve. This should substantially decrease the amount of wear and tear experienced by a drivers license as it is the sleeve itself which experiences the wear and tear of insertion and removal from within the wallet slot. Furthermore, as the front surface of the drivers license is exposed, a user may readily remove it from within the sleeve by merely pressing his fingers against the drivers license and pushing it out of the slots formed by the edge channels as an edge channel is held.

In order to accommodate wallet slots providing access either along their top or side, the wallet identification card sleeve of the present invention is provided in either of two embodiments, one having its open edge and finger grab along an upper, longer edge and the other having its open edge and finger grab along a side or shorter edge.

While the principal advantages and features of the present invention have been briefly described above, a fuller understanding of the invention may be attained by referring to the drawings and description of the preferred embodiment which follows.

DETAILED DESCRIPTION OF THE PREFERRED EMBODIMENT

Figure 1:
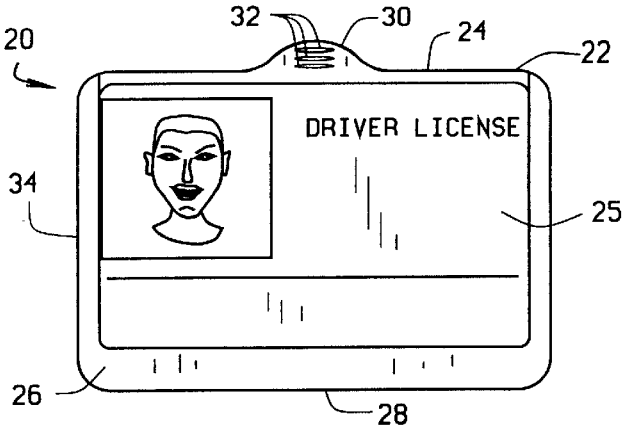
FIG. 1 is a top view of the wallet identification card holder of the present invention with a drivers license inserted therein.
Figure 2:
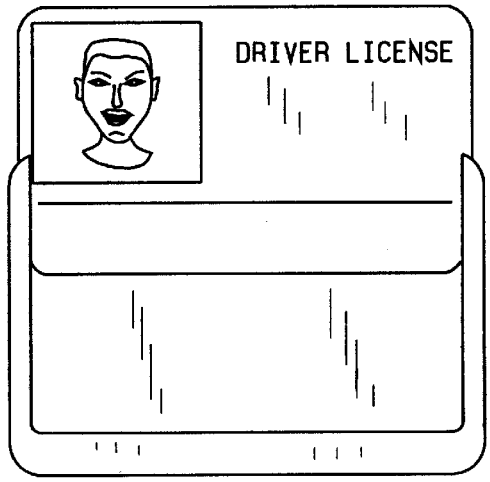
FIG. 2 is a top view of the present invention, similar to that shown in FIG. 1, except that the drivers license is positioned half in and half out of the wallet identification card holder.
Figure 3:
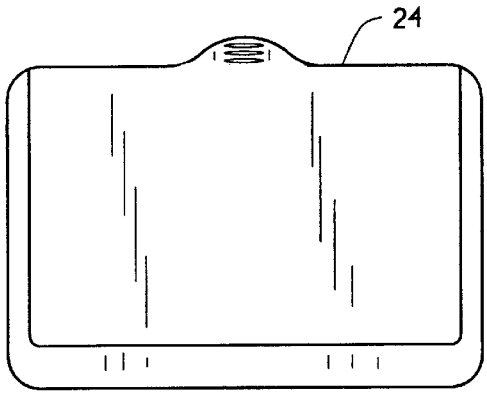
FIG. 3 is a top view of the wallet identification card holder of the present invention.
Figure 4:
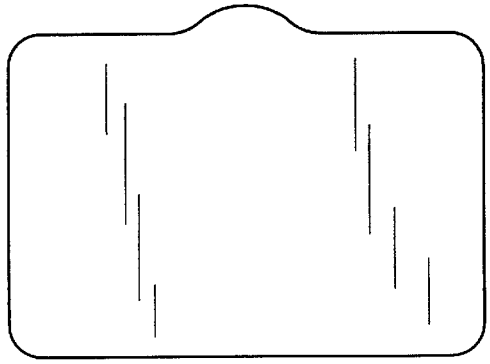
FIG. 4 is a bottom view of the wallet identification card holder of the present invention.
Figure 5:
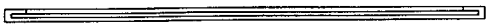
FIG. 5 is a side view of the wallet identification card holder of the present invention.

As shown in FIGS. 1 to 5, the first embodiment 20 of the present invention is comprised of a sleeve 22 having a back panel or tray 24 which is sized to be approximately the same size as a typical credit card, drivers license 25, or other commonly sized card desired to be carried in the wallet of a user. The tray 24 has an upstanding edge channel 26 around the periphery of three sides of tray 24. This edge channel 26 has a lip 28 which partially overlaps the identification card 25 to help retain it within the sleeve 22. Lip 28 may be chosen to be any appropriate size and is preferably larger along the lower edge of sleeve 22 than at the sides thereof. A tab or finger grab 30 is preferably integrally formed with the tray 24 and has a plurality of raised ribs 32 to facilitate a user's grasping of the finger grab 30 to insert and remove the sleeve 22 from a wallet slot. The edge channel 26 may preferably be integrally formed with tray 24 or separately formed and joined to the tray 24 along a joinder line 34. It is noted that the outline of joinder line 34 circumscribes substantially the periphery of the identification card 25 with some tolerance given to facilitate the identification card 25 being readily removed and reinserted into sleeve 22.

The sleeve 22 may be constructed of any semi-rigid plastic material such as nylon or the like and provided with a sandblasted textured finish. Similarly, the plurality of raised ribs 32 may also be substituted for with any suitable texturing or the like so as to enhance its ability to be grasped. Furthermore, finger grab 30 may have an enhanced or increased thickness over that of tray 24.

Figure 6:
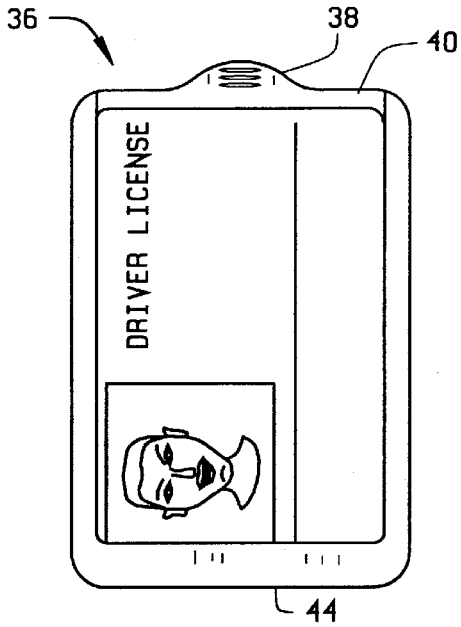
FIG. 6 depicts a second embodiment of the present invention adapted for side entry and removal of identification card from the wallet identification card holder.
Figure 7:
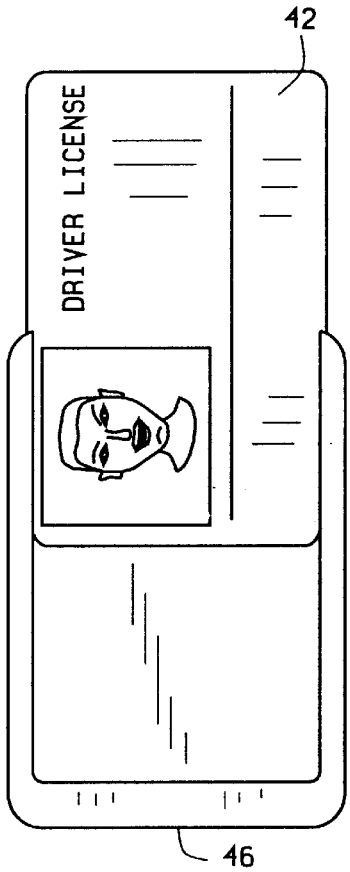
FIG. 7 is a top view of the second embodiment with the identification card half in and half out of the identification card holder.
Figure 8:
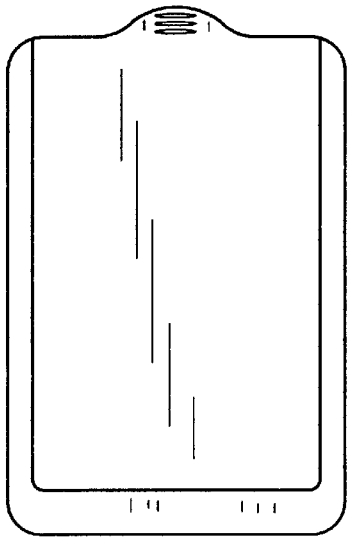
FIG. 8 is a top view of the second embodiment of the wallet identification card holder.
Figure 9:
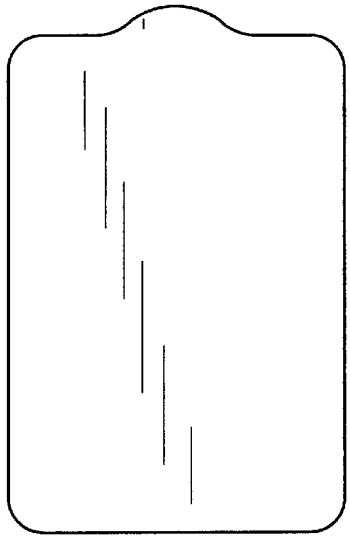
FIG. 9 is a bottom view of the second embodiment of the wallet identification card holder.
Figure 10:
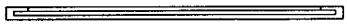
FIG. 10 is a side view of the second embodiment of the wallet identification card holder.

A second embodiment 36 is shown in FIGS. 6 to 10 and is very similar to the first embodiment 20 except that the finger grab 38 is located along a side of tray 40 such that the identification card 42 is inserted and removed from the sleeve 36 from the side instead of from the top thereof. An edge channel 44 is provided along the periphery of three sides of tray 40 and may be either integrally formed or preferably joined in an assembly along a joinder line 46.

Both embodiments 20, 36 are intended to be relatively thin yet semi-rigid or flexible enough to comfortably be fitted into a typical wallet slot and bend to the limited extent required by a typical user's wearing of a wallet in his hip pocket. In other words, the invention is intended to protect an identification card without adding any discomfort to the wearer's use thereof should the wearer routinely carry his wallet in his hip pocket. Additionally, the finger grab allows for a user to readily identify the location of the identification card within the various wallet slots provided in a typical wallet. This also permits the identification card to be readily removed in a simple easy reliable motion and displayed when desired. Furthermore, reinsertion of the identification card is also facilitated as the semi-rigid nature of the sleeve provides sufficient stiffness so that it may be inserted into a wallet slot with minimal binding, etc. As the upper surface of the sleeve is open, the face of the identification card is exposed for clear viewing of the information contained thereon. Additionally, the identification card may be readily slid into or removed from the sleeve by a user's grasping of the sides of the sleeve and using the fingers of his other hand to slide the card in or out of the sleeve.

Various changes and modifications of the present invention would be apparent to those of ordinary skill in the art. Those modifications and changes include, but are not limited to, repositioning of the finger grab, reshaping of its design or providing different texturing, providing fewer edge channels or making them discontinuous, using any of a variety of plastic materials providing sufficient flexibility and yet rigidity to accommodate typical usage experienced in a wallet, etc. These changes and modifications are intended to be included within the scope of the present invention which should be considered as limited only by the claims and their legal equivalents.

What is claimed is:

1. A wallet identification card holder comprising an integrally formed semi-rigid plastic sleeve having an edge bracket surrounding three sides thereof, said edge bracket defining a slot for receiving and guiding said card as it is inserted into said holder, and an extension from the side of said holder not having an edge bracket, said extension being generally semi-circular in shape and flat to lie in substantially the same plane as said sleeve, said extension providing a convenient place for grasping and removing said holder from a wallet and having a plurality of raised ribs on said extension to improve its ability to be gripped by a finger.

2. The wallet identification card holder of claim 1, wherein:

the sleeve is dimensioned such that the sleeve has a thickness less than 2.5 millimeters.

3. The wallet identification card holder of claim 1, wherein:

the sleeve has a flat tray portion and the edge bracket comprises a lip that is spaced from the tray portion and that extends along the edge bracket at a constant distance from the tray portion.

4. The wallet identification card holder of claim 1, wherein:

the sleeve is generally rectangular.

5. The wallet identification card holder of claim 4, wherein:

the sleeve has at least two curved corners and the edge bracket extends therealong.

6. A sleeve for carrying a card sized item in a wallet, the sleeve comprising:

a generally flat tray having a plurality of sides; a plurality of edge channels extending along at least two of the sides of the tray, the edge channels providing a slot into which a card size item can be inserted and held adjacent the tray, the tray and edge channels being minimally dimensioned such that the sleeve can be inserted into a conventional pocket of a wallet of the type that is configured to hold a single credit card; and a tab extending outwardly from and parallel to the tray to facilitate grasping of the sleeve by a person's fingers for removal of the sleeve from within such a pocket of a wallet, the tab having a plurality of ridges to further facilitate grasping of the sleeve for removal of the sleeve from within a pocket of a wallet.

7. The sleeve of claim 6, wherein:

the sleeve is dimensioned such that the sleeve has a thickness less than 2.5 millimeters.

8. The sleeve of claim 6, wherein:

the sleeve is fabricated of a resiliently flexible material that allows the tray to flex substantially out-of-plane without permanently deforming.

9. The sleeve of claim 6, wherein:

the tab extends from one of the plurality of sides of the flat tray that is devoid of any of the plurality of edge channels.

10. The sleeve of claim 6, wherein:

the plurality of edge channels each comprise a lip that is spaced from the tray, each of the lips extending along the respective edge channel at a constant distance from the tray equal to that of the other of the lips.

11. The sleeve of claim 6, wherein:

the tab has a curved edge along which the tab terminates.

12. The sleeve of claim 6, wherein:

the tray is generally rectangular and the plurality of edge channels comprise at least three edge channels that extend from the tray along at least three of the sides of the tray.

13. The sleeve of claim 12, wherein:

two of the three edge channels oppose each other and intersect the other of the three edge channels.

14. The sleeve of claim 13, wherein:

the tray has at least two curved corners and each of the two of the three edge channels intersects the other of the three edge channels along one of the curved corners of the tray.

15. An improvement to a sleeve of the type comprising a flat tray having a plurality of sides and a plurality of edge channels extending from the tray along at least two of the sides of the tray for providing a slot into which an identification card can be inserted and held adjacent the tray with a substantial portion of the identification card remaining exposed when inserted therein, the improvement comprising:

the tray and channels of the sleeve being dimensioned such that substantially all of the sleeve can be inserted into a wallet pocket of the type configured to snugly hold an identification card;

a tab extending outwardly from and parallel to the tray, the tab having a plurality of ridges to facilitate grasping of the sleeve and being positioned on the sleeve where it will protrude from a wallet pocket of the type configured to snugly hold an identification card when the sleeve is fully inserted into such a wallet packet.

16. The improvement of claim 15, wherein:

the sleeve is dimensioned such that the sleeve has a thickness less than 2.5 millimeters.

17. The improvement of claim 15, wherein:

the sleeve is fabricated of a resiliently flexible material that allows the tray to flex substantially out-of-plane without permanently deforming.

18. The improvement of claim 15, wherein:

the tab extends from one of the plurality of sides of the tray that is devoid of any of the plurality of edge channels.

19. The improvement of claim 15, wherein:

the plurality of edge channels each comprise a lip that is spaced from the tray, each of the lips extending along the respective edge channel at a constant distance from the tray equal to that of the other of the lips.

20. The improvement of claim 15, wherein:

the tab has a curved edge along which the tab terminates.

21. The improvement of claim 15, wherein:

the tray is generally rectangular and the plurality of edge channels comprise at least three edge channels that extend from the tray along at least three of the sides of the tray.

22. The improvement of claim 21, wherein:

two of the three edge channels oppose each other and intersect the other of the three edge channels.

23. The improvement of claim 22, wherein:

the tray has at least two curved corners and each of the two of the three edge channels intersects the other of the three edge channels along one of the curved corners of the tray.

24. The improvement of claim 23, wherein:

the tab extends from one of the plurality of sides of the flat tray that is devoid of any of the plurality of edge channels.

* * * * *